United States Patent [19]

Graziani et al.

[11] Patent Number: 4,923,591

[45] Date of Patent: May 8, 1990

[54] CONTINUOUS LUBRICATING OIL DEWAXING PROCESS

[75] Inventors: Kenneth R. Graziani, Woodbury; James R. Katzer, Moorestown; Chwan P. Kyan, Manuta, all of N.J.

[73] Assignee: Mobil Oil Corporation, New York, N.Y.

[21] Appl. No.: 140,452

[22] Filed: Jan. 4, 1988

[51] Int. Cl.[5] ..... C10G 45/18

[52] U.S. Cl. ..... 208/111; 208/152; 208/176

[58] Field of Search ..... 208/111, 156, 74, 165, 208/176, 152

[56] References Cited

U.S. PATENT DOCUMENTS

| | | | |
|---|---|---|---|
| 1,867,841 | 7/1932 | Joseph | 208/74 |
| 2,031,600 | 2/1966 | Harrison et al. | 208/74 X |
| 2,303,076 | 11/1942 | Frolich | 208/74 |
| 2,425,555 | 8/1947 | Nelson | 208/156 |
| 2,654,400 | 9/1958 | Weisz | 208/111 |
| 2,656,306 | 10/1953 | Bergstrom | 208/152 |
| 2,786,800 | 3/1957 | Meyers | 208/152 |
| 3,309,305 | 4/1967 | Scott | 208/111 |
| 3,343,146 | 7/1968 | Dill et al. | 208/74 X |
| 3,441,626 | 4/1969 | Kelly | 208/143 |
| 3,826,737 | 7/1974 | Pegels et al. | 208/143 |
| 4,229,282 | 10/1980 | Peters et al. | 208/111 |
| 4,259,294 | 3/1981 | Van Zijll Langhout et al. | 422/190 |
| 4,360,419 | 11/1982 | Miller | 208/111 |
| 4,414,097 | 11/1983 | Chester et al. | 208/111 |
| 4,510,044 | 4/1985 | Oleck et al. | 208/111 |
| 4,567,023 | 1/1986 | Greenwood et al. | 422/192 |
| 4,605,488 | 8/1986 | Chester et al. | 208/78 |
| 4,648,957 | 3/1987 | Graziani et al. | 208/58 |

OTHER PUBLICATIONS

G. D. Hobson et al., *Modern Petroleum Technology*, 4th Ed., p. 309.

*Primary Examiner*—Glenn Caldarola

*Attorney, Agent, or Firm*—Alexander J. McKillop; Charles J. Speciale; Malcolm D. Keen

[57] ABSTRACT

Process for the continuous catalytic dewaxing of lube containing feeds wherein the feed effectively moves countercurrently to the catalyst. The process is based on the discovery that in a two-stage catalytic dewaxing process the stage-two or back-end dewaxing catalyst shows a concave upward aging when it is used to produce a targeted pour point lube, but the back-end dewaxing catalyst can be used as a stage one or front-end dewaxing catalyst to produce an intermediate pour point product.

10 Claims, 4 Drawing Sheets

CONTINUOUS LUBRICATING OIL DEWAXING PROCESS

BACKGROUND OF THE INVENTION

1. Field of the Invention

This invention relates to a method for the continuous catalytic dewaxing of lubricating oils.

2. Discussion of Related Art

In general, crude oil, as shown by experience or by assay, contains a quantity of lubricant stock having a predetermined set of properties such as viscosity, oxidation stability, and maintenance of fluidity at low temperatures. The process of refining to isolate that lubricant stock consists of a number of subtractive unit operations which remove the unwanted components. The most important of these unit operations include distillation, solvent refining, and solvent dewaxing, which basically are physical separation processes in that all the separate fractions, if recombined, would reconstitute the initial crude oil.

Solvent dewaxing is a well-known effective process for removing the wax components, but it is expensive, and, solvent dewaxing merely removes wax, rather than converting the wax to lighter products. More recently catalytic methods for dewaxing have been proposed. U.S. Pat. No. Re. 28, 398, the entire disclosure is herein incorporated by reference, describes a catalytical dewaxing process wherein a particular crystalline zeolite is used.

Catalytic dewaxing processes not only remove the waxy components of hydrocarbon feedstocks, but also convert such components into other materials of higher value. Catalytic dewaxing processes achieve this end by selectively cracking long chain n-paraffins and some branched paraffins to produce low molecular weight products which may be removed by distillation.

Current technology for catalytically dewaxing petroleum feedstocks, having elevated pour points, involves the use of dewaxing reactors having trickle beds, whereby gas (primarily hydrogen) and the feedstock co-currently flow downward over a bed of solid catalyst. Typically, a single reactor is used. However, for low space velocity designs, multiple catalytic dewaxing reactors in series may be used to stay within allowable engineering designs, i.e. the lengths and weights used for a single reactor. The feedstock is to be catalytically dewaxed to a product having a targeted pour point of between about 20° F. to −50° F. (−6.7° C. to −45.6° C.). However, because of trace poisons in the feed such as nitrogen and metal, and by virtue of the occurrence of side reactions caused by the presence of olefins, the dewaxing catalyst gradually loses activity. This lost activity is usually compensated for by gradually raising the temperature of the dewaxing reactor. By raising the reactor temperature, a constant pour point product can be obtained as the catalyst loses activity. However, a temperature ceiling of about 675° F. (357° C.) is imposed on the process to maintain product quality and because the dewaxing catalyst rapidly deactivates above this ceiling. Thus, on reaching the ceiling temperature the reactor is shut down and the catalyst is reactivated.

The reactivation of dewaxing catalysts by hydrogen and oxygen reactivation is expensive because it causes down time which reduces the stream factor. That is, it reduces the time the reactor is on-stream. Stream factor is defined as the quotient of time of the reactor on-stream, divided by the total time the reactor is capable of use. Ideally this quotient is one. Unfortunately, in conventional dewaxing methods, the reactor is taken off-line for maintenance or for the reactivation of the catalyst. In such instances, the quotient is reduced to much less than one, thus increasing costs of making lube.

Hydrogen reactivation of the catalyst is accomplished by contact with elemental $H_2$ at temperatures between 800° F. and 1000° F. (427° C. to 538° C.). Hydrogen reactivation usually removes soft deposits of coke. Hydrogen reactivation, however, does not completely restore the original level of activity of the catalyst. For example, it has been observed that following hydrogen reactivation of an HZSM-5 catalyst, the cycle length for catalytic dewaxing operations was substantially less than the original cycle length. The number of days the catalyst can remain on stream decreases from cycle to cycle and eventually continued reactivation becomes impractical. This loss of activity is trogen, sulfur and oxygen hetero atoms left on the catalyst which hydrogen activation does not remove. After a predetermined level of deactivation, oxygen is used to burn this hard coke residue off the catalyst and to restore most of the fresh catalyst activity. Catalyst reactivation is described in more detail in U.S. Pat. Nos. 3,904,510; 3,986,982; and 3,418,526.

It would be desirable to keep catalytic dewaxing reactors and the dewaxing cycle on-line or on-stream for longer periods of time to improve the stream factor and therefore the economics of catalytically dewaxing lubricating oils.

The present inventors have observed that in a two-stage catalytic dewaxing process, the dewaxing catalyst in stage-one or the first reactor shows a "line-out" aging in producing an intermediate pour point product, and the dewaxing catalyst in stage two or the second reactor shows a concave upward aging in dewaxing the intermediate pour product to a product having a targeted pour point. Thus, the stage-two dewaxing catalyst ages faster than the stage-one dewaxing catalyst and therefore the stage-two dewaxing catalyst is a limiting factor in the dewaxing cycle of the two-stage catalytic dewaxing processes. However, at the end of the cycle the stage-two dewaxing catalyst, even though it could no longer produce the target pour point, was found capable of catalytically dewaxing a feed to the intermediate pour point product while exhibiting the same line-out aging as the stage-one dewaxing catalyst. This aging data implies that in a conventional single stage catalytic dewaxing process, the aged catalyst from the back-end of the dewaxing reactor can be used at the front-end of the dewaxing reactor without reducing the performance of the catalytic dewaxing process. Replacement with a fresh or reactivated catalyst is only needed at the reactor back-end. This unique aging characteristic suggested to the inventors the feasibility of a continuous catalytic dewaxing process to bring the stream factor closer to one.

SUMMARY OF THE INVENTION

In view of the above observations, the instant invention relates to a continuous process for conducting dewaxing processes and relates more particularly to a continuous process for catalytically dewaxing a hydrocarbon feedstock, comprising:

(a) contacting the hydrocarbon feedstock with hydrogen gas and a dewaxing catalyst in a moving bed reactor wherein the catalyst and feedstock effectively move countercurrently relative to one another; and (b) recovering a liquid hydrocarbon having a reduced pour point relative to the original feedstock.

DESCRIPTION OF THE PREFERRED EMBODIMENTS

Figure 1:
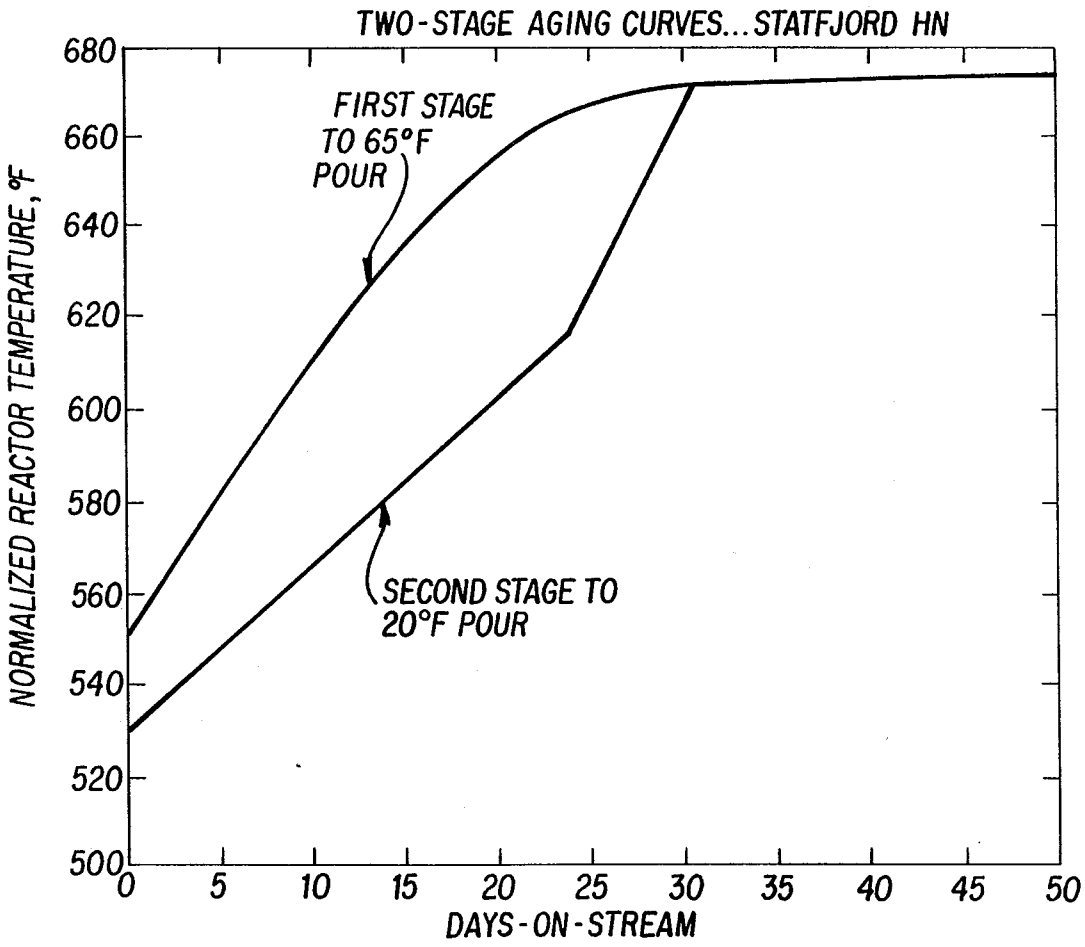
FIG. 1 summarizes aging data of dewaxing catalyst used in two-stage catalytic dewaxing.

As discussed above, and as shown in FIG. 1, the present inventors have discovered that a stage-two dewaxing catalyst operating in a two stage catalytic dewaxing process shows concave upward aging of the dewaxing catalyst as the catalytic dewaxing reactor, housing the catalyst, remains on-line producing a product having a targeted pour point. A catalytic dewaxing reactor housing a stage-two dewaxing catalyst receives a feedstock which has been catalytically dewaxed to an intermediate pour point by a stage-one dewaxing catalyst. The stage-two dewaxing catalyst dewaxes the intermediate pour point product to a targeted pour point product. However, as shown in FIG. 1 the stage-two dewaxing catalyst shows concave upward aging, and thus the stage-two dewaxing catalyst ages faster than the identical front-end dewaxing catalyst. This aging data implies that in a conventional single stage dewaxing process, a catalyst in the back-end of the reactor limits the dewaxing cycle, and the aged catalyst from the back-end of the reactor can be used at the front end of the dewaxing reactor without reducing the performance of the catalytic dewaxing process. Replacement with a fresh or reactivated catalyst is only needed at the reactor back-end. Conventionally, deactivated dewaxing catalyst, in all of the catalytic dewaxing reactors, has to be reactivated requiring a shut down of the dewaxing process. The present inventors have discovered, however, that if a deactivated back-end dewaxing catalyst is employed in the front end of the reactor, it is capable of dewaxing a feedstock to the desired intermediate pour point that the front-end dewaxing catalyst normally handles, and that the deactivated back-end dewaxing catalyst, used in the front end of the catalytic dewaxing reactor exhibits the same line-out aging as the original front-end dewaxing catalyst.

Based on the knowledge above, the inventors have discovered that a catalytic dewaxing process no longer has to be accomplished in batch, but that a continuous catalytic dewaxing process can be conducted. The continuous process is achieved by conducting the catalytic dewaxing process so that dewaxing catalyst and feedstock flow effectively countercurrently to one another.

The present process is applicable for catalytic dewaxing feedstocks when a low pour point product is desired. The feedstocks may comprise hydrocarbons having a boiling point of at least 400° F. (204° C.) and particularly those having a boiling point of at least about 600° F. (316° C.). The feeds may be virgin or prefractionated hydrocarbons. Typically, the lube oil feedstock has a pour point greater than about 80° F. (27° C.). Such feedstocks will normally be composed of $C_{16}+$ components since lighter oils will be free of significant quantities of waxy components. The invention is particularly applicable to catalytically dewaxing distillate stocks, such as gas oils, kerosenes, jet fuels, lubricating feed, oil stocks, heating oils and other distillate fractions, whose pour point and viscosity need to be maintained within certain specified limits.

Figure 4:
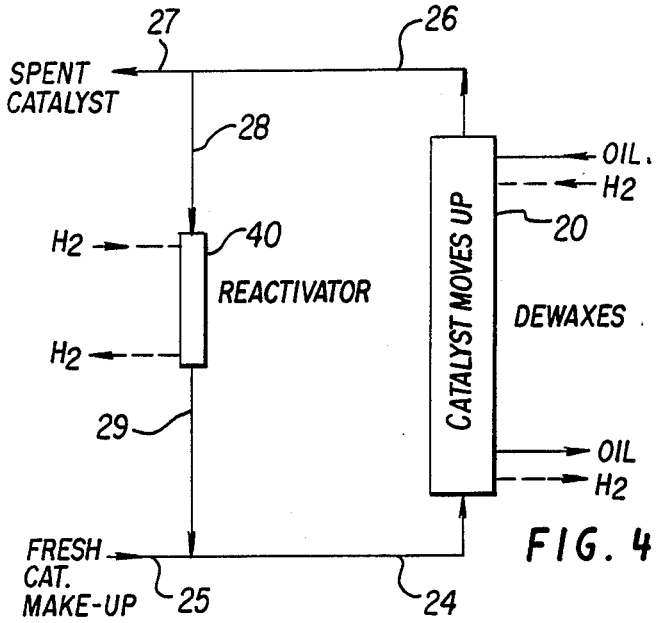
FIG. 4 is a schematic diagram of a continuous process for dewaxing lubricating oils wherein the flow of dewaxing catalyst is countercurrent to the flow of lube within the reactor.

When reference to FIG. 4, the initial liquid feedstock enters the top of catalytic dewaxing reactor 20. Hydrogen gas may be conveyed through the same conduit.

The catalytic dewaxing reactor 20 contains the dewaxing catalyst. Front-end, and back-end dewaxing catalysts are so designated according to their location in the catalytic dewaxing reactor. Front-end and back-end dewaxing catalysts are similar, and the only substantial difference between them is their location in the reactor. Front-end dewaxing catalyst is physically closer to the feed as the feed enters the reactor and back-end dewaxing catalyst is further away from the entering feed. The front-end dewaxing catalyst processes easier-to-dewax components of the feed such as straight chain or slightly-branched paraffins and the back-end dewaxing catalyst dewaxes the harder-to-dewax components such as multiple branched components. The dewaxing reactor 20 is operated in the range from about 400° F. to about 800° F. (204° C. to 427° C.), preferably at about 500° F. to 675° F. (260° C. to 357° C.), a pressure from about 100 psig to 2000 psig (8 bars to 139 bars), preferably about 350 psig to about 650 psig (25 bars to 46 bars); at a hydrogen feed rate from about 500 to about 100,0000 SCF/bbl of lube oil feedstock, preferably about 1,500 to about 4,000 SCF/bbl. The overall liquid hourly space velocity (LHSV) of the reactor 20 ranges from about 0.25 to about 4 hours$^{-1}$, preferably at about 0.25 to 1.0 hours$^{-1}$. Overall, LHSV represents (feet$^3$ of reactants/hours) per feet$^3$ of catalyst in the reactor.

Figure 5:
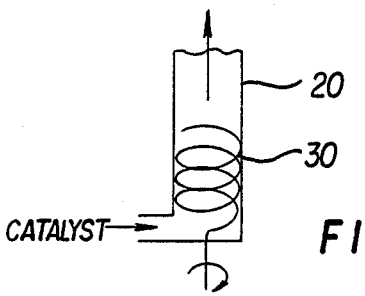
FIG. 5 is a mechanical device for transporting dewaxing catalyst in the upward direction in any one of the reactors in FIGS. 4 and 6.

The initial liquid feedstock contacts the front-end catalyst at the top of the reactor 20 and the feedstock continues to travel downwardly through reactor 20, being subject to the dewaxing process under the conditions described above. In view of the fact that such an initial feedstock contacts fresh catalyst a low pour point product, i.e. a product having a pour point of about 0° F., may be produced and removed at the bottom of the reactor along with unreacted hydrogen gas as shown. As the reactor 20 continues to operate, the back-end dewaxing catalyst will gradually age faster than the front-end dewaxing catalyst. Normally the reactor temperature would be raised to compensate for the reduced catalytic dewaxing ability primarily because of the deactivation of the back-end dewaxing catalyst. Such temperature increases will soon approach a ceiling, signaling a need to reactivate the dewaxing catalyst. But instead of raising the reactor temperature, the front-end dewaxing catalyst is removed from the top of the dewaxing reactor 20, and the initial back-end dewaxing catalyst, originally performing more difficult catalytic dewaxing, is moved to the front-end position to catalytically dewax easier-to-dewax components, thus operating as the front-end dewaxing catalyst. Fresh make-up and reactivated, dewaxing catalyst are added to the bottom of reactor 20, by conduit 24. Screw 30 (FIG. 5) conveys the dewaxing catalyst upwards through the reactor. The front-end dewaxing catalyst is removed from the top of catalytic dewaxing reactor 20 through conduit 26. It is recycled via conduit 28 through reactivator 40 where $H_2$ or $O_2$ reactivation is carried out after a small portion of the catalyst is rejected via conduit 27 to maintain catalyst balance, based on weight. The removal of deactivated dewaxing catalyst from the top of catalytic dewaxing reactor 20 and the conveying of fresh and reactivated dewaxing catalyst to the bottom of catalytic dewaxing reactor 20 effects a countercurrent flow of the dewaxing catalyst relative to the flow of hydrocarbon liquid.

In summary, the back-end dewaxing catalyst originally performing the harder catalytic dewaxing operation now performs the easier catalytic dewaxing even though it has aged. The back-end catalytic dewaxing, the limiting reaction of the process, is now performed by a fresher dewaxing catalyst and the back-end dewaxing catalyst operates as a front-end dewaxing catalyst. By this process, the catalytic dewaxing process can remain on-line or on-stream continuously. The stream factor for this continuous process more nearly approaches one relative to conventional catalytic dewaxing techniques.

The continuous dewaxing process as described is an efficient process as evidenced by the fact that the stream factor approaches one. A catalytic dewaxing reaction taking place in a conventional dewaxing reactor will proceed for a period of about 25 days before reaching its ceiling temperature. Of course, this time period may be altered by changing the space velocity or the composition of the feeds. Thereafter, the catalyst usually has to be reactivated by taking the reactor off-line. In view of this fact, one with ordinary skill in the art would realize that the upward migration of catalyst via screw 30 is a slow process and the rate of travel of the catalyst through the reactor will be determined by an operator as fresh and reactivated catalyst are added to catalytic dewaxing reactor 20 to compensate for the rate of catalyst aging.

The continuous process has a number of advantages. Firstly, an operator can now select a specific temperature to run specific dewaxing processes. This selected temperature can be maintained throughout by adding fresh or reactivated catalyst, thus allowing for isothermal conditions. Secondly, by maintaining a constant selected temperature, a better quality product can be produced. Thirdly, the process allows for the use of catalyst having more uniform activity with respect to time on stream which produces a more uniform dewaxed product.

As fresh make-up catalyst and reactivated catalyst move into catalytic dewaxing reactor 20 from conduit 24, deactivated dewaxing catalyst exits via conduit 26. The catalyst is recycled via conduit 28 through reactivator 40 where $H_2$ or $O_2$ reactivation is carried out after a small portion of the catalyst is rejected via conduit 27 to maintain the catalyst balance of the system. Although reactivation is conducted in a hydrogen atmosphere, as shown by the drawings, the catalyst may also be reactivated in an oxygen atmosphere. Reactivation takes place under the conditions described above. The reactivated catalyst leaves reactivator 40 via conduit 29 and enters conduit 24 and reactivated catalyst, and fresh make up catalyst entering the system through conduit 25, are thereafter conveyed to catalytic dewaxing reactor 20. The reactor system is provided with valves (not shown) to control the flow path of catalyst, liquids, and gases.

Figure 6:
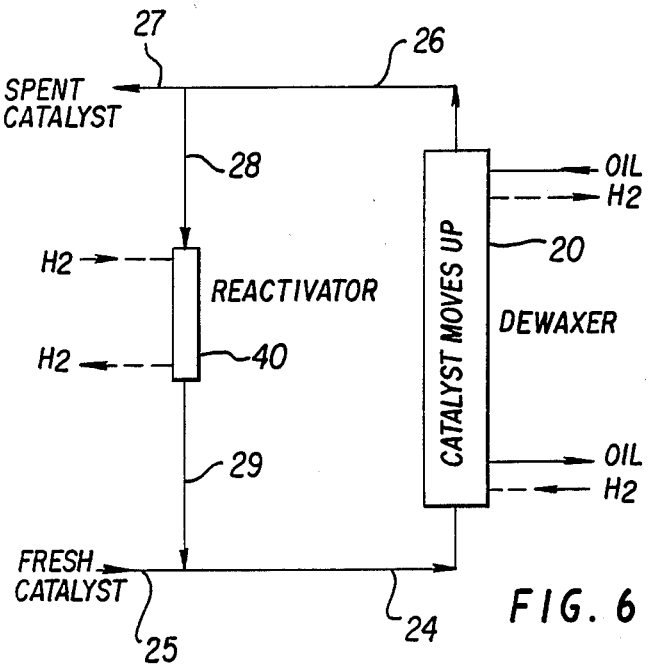
FIG. 6 is a second schematic diagram of a process for the continuous dewaxing of lubricating oils.

FIG. 6 is a schematic diagram showing another embodiment of the claimed invention wherein hydrogen is added to reactor 20 so that it flows upwardly cocurrently with the catalyst and countercurrently to the flow of oil. Elements of the device of FIG. 6 are essentially equivalent to those of FIG. 4.

Figure 7:
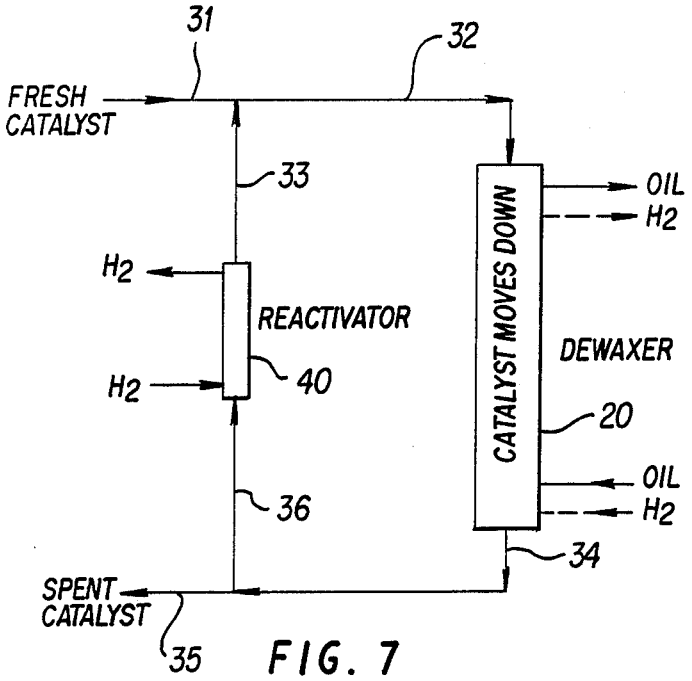
FIG. 7 is another schematic diagram of a third embodiment of the process of the invention.

The embodiment shown in FIG. 7 is similar to that shown in FIGS. 4 and 6. However, in FIG. 7 the catalyst moves downwardly through the reactor by gravity, pneumatic devices or through mechanical devices, and the oil and hydrogen gas are conveyed in the upward direction. For instance, fresh and reactivated dewaxing catalyst can enter the top of dewaxing reactor 20 from conduits 31 and 32 or 33 and 32. The catalyst is moved in the downward direction as oil and hydrogen gas move countercurrently relative to the catalyst. In this embodiment, front-end catalytic dewaxing is taking place at the bottom of reactor 20, where the feed enters the reactor, and back-end catalytic dewaxing is taking place at the top of reactor 20 where fresh make-up and reactivated catalyst enter reactor 20. The catalyst is removed from reactor 20 via conduit 34 and can be sent to reactivator 40 via conduits 34 and 36 after disposing of a small portion of the catalyst via conduits 34 and 35 to maintain catalyst balance by weight in the system.

Figure 8:
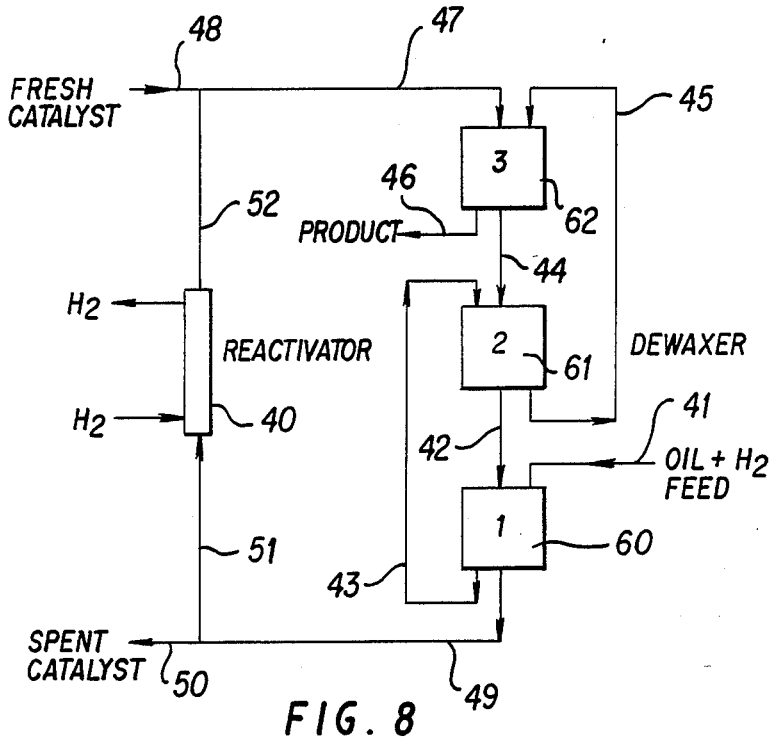
FIG. 8 is a final schematic diagram wherein three reactors are used in a process for the continuous dewaxing of lubricating oils.

FIG. 8 is a schematic diagram of another embodiment of the invention. In this embodiment, three dewaxing reactors are assembled in series. An initial feedstock and hydrogen gas are fed to the top of reactor 60, the last reactor in the series, via conduit 41 and a charge of catalyst is fed to the reactor via conduit 42. Typically, the catalyst charged to reactor 60 through conduit 42 has been used in a catalytic dewaxing process.

Subjecting the feedstock to dewaxing conditions as described above produces a lube oil product having a reduced pour point relative to the original feed and this reduced pour point product is discharged from catalytic dewaxing reactor 60 via conduit 43, and is then cycled up through conduit 43 with unreacted hydrogen gas to a second catalytic dewaxing reactor 61. Catalytic dewaxing reactor 61 is a second catalytic dewaxing reactor in the series of catalytic dewaxing reactors. A second charge of catalyst is conveyed to catalytic dewaxing reactor 61 via conduit 44 and the product having a reduced pour point is again subjected to dewaxing conditions to produce a lube oil product having an intermediate pour point. Intermediate pour point product is discharged from catalytic dewaxing reactor 61 via conduit 45 and is conveyed via conduit 45 with unreacted hydrogen gas to the top of catalytic dewaxing reactor 62. Catalytic dewaxing reactor 62 is the first catalytic dewaxing reactor of the series. The intermediate pour point product is then subjected to catalytic dewaxing conditions and a product having a targeted pour point of about between 20° F. to −50° F. (−6.7° C. to −45.6° C.) is produced and discharged from reactor 62 via conduit 46. Fresh make-up and reactivated dewaxing catalyst is added to catalytic dewaxing reactor 62 via conduits 47, 48 and conduits 52. A portion of the reactivated dewaxing catalyst is removed from the dewaxing reactor, via conduit 50, to maintain catalyst balance by weight. The remaining reactivated catalyst is conveyed to reactivator 40 through conduits 49 and 51 for reactivation.

As is readily apparent, the dewaxing catalyst and the oil in this embodiment flow co-currently in each of reactors 60 through 62. However, in view of the fact that the initial feedstock enters the last catalytic dewaxing reactor in the series, catalytic dewaxing reactor 60, and a product thereof is conveyed upwardly to catalytic dewaxing reactors discharging dewaxing catalyst to catalytic dewaxing reactors below, the hydrocarbon oil is effectively subjected to countercurrent flow relative to the dewaxing catalyst. That is, front-end dewaxing catalyst, as it ages, is moved out of catalytic dewaxing reactor 60 and backend dewaxing catalyst moves into the catalytic dewaxing reactor 60 from catalytic dewaxing reactor 61. This sequence of operations replaces the front-end dewaxing catalyst with back-end dewaxing catalyst which has aged and is no longer capable of performing the more difficult catalytic dewaxing of multiple branched compounds. However, the repositioned back-end dewaxing catalyst will age similarly to the line-out aging of the front-end dewaxing catalyst in performing the dewaxing of normal or slightly branched compounds. Fresh make-up and reactivated dewaxing catalyst may be added to the last reactor in the series and these stages are then used to conduct the back-end dewaxing sequence. Such a process may be conducted with two, or more than three, reactors. Movement of the lube oil outside of the reactors, countercurrently to liquid moving through reactors in a second direction, produces a countercurrent movement of liquid and catalyst, albeit outside of the reactor. The phrase "effectively move countercurrently to one another", as recited in the claims, refers to countercurrent movement of catalyst relative to liquid, whether countercurrent movement occurs inside, or outside of the reactor or reactors.

Catalysts

A portion of the class of zeolites useful for catalytic hydrodewaxing are termed medium or intermediate pore size zeolites and are characterized by an effective pore size of generally less than about 7 Angstroms, and/or pore windows in a crystal formed by 10-membered rings. The medium or intermediate pore size zeolites are represented by those zeolites having the structure of ZSM-5, ZSM-11, ZSM-12, ZSM-23, ZSM-35, ZSM-38, ZSM-48, and TMA (tetra methyl ammonium) Offretite.

By "intermediate pore size zeolite", as used herein, is meant zeolites having the unique characteristic of being able to differentiate between large molecules and molecules containing quaternary carbon atoms on the one hand, and smaller molecules on the other hand. Thus, the intermediate pore size materials have surprising catalytic activity and stability when compared to most of the larger pore size crystalline zeolites.

The effective pore size of zeolites can be measured using standard absorption techniques and compounds of known minimum kinetic diameters. See Breck, *Zeolite Molecular Sieves,* 1974 (especially Chapter 8), and Anderson et al, *J. Catalysis* 58, 114 (1979), both of which are incorporated herein by reference.

Intermediate pore size zeolites in the H-form will typically admit molecules having kinetic diameters of 5.0 to 6.5 Angstroms with little hindrance. Examples of such compounds (and their kinetic diameters in Angstroms) are n-hexane (4.3), 3-methylpentane (5.5), benzene (5.85), and toluene (5.8). Compounds having kinetic diameters of about 6 to 6.5 Angstroms can be admitted into the pores, depending on the particular sieve, but do not penetrate as quickly and, in some cases, are effectively excluded. Compounds having kinetic diameters in the range of 6 to 6.5 Angstroms include: cyclohexane (6.0), 2,3-dimethylbutane (6.1), m-xylene (6.1), and 1,2,3,4-tetramethylbenzene (6.4). Generally, compounds having kinetic diameters of greater than about 6.5 Angstroms do not penetrate the pore apertures, and thus are not absorbed into the interior of the zeolite lattice. Examples of such larger compounds include: hexamethylbenzene (7.1), 1,3,5-trimethylbenzene (7.5), and tributylamine (8.1).

In performing adsorption measurements to determine effective pore size, standard techniques are used. It is convenient to consider a particular molecule as excluded if it does not fill at least 80% of the zeolite pore volume in less than about one hour ($p/p_o=0.5$; 25° C.).

The acid activity of zeolite catalysts is conveniently defined by the alpha scale described in an article published in *Journal of Catalysis,* Vol. VI, pp. 278–287 (1966). In this test, the zeolite catalyst is contacted with hexane under conditions prescribed in the publication, and the amount of hexane which is cracked is measured. From this measurement is computed an "alpha" value which characterizes the catalyst for its cracking activity for hexane. The entire article above referred to is incorporated herein by reference. The alpha scale so described will be used herein to define activity levels for cracking n-hexane. And, in particular, for purposes of this invention, a catalyst with an alpha value of not greater than about 1.0, and preferably not greater than about 0.5, will be considered to have substantially no activity for cracking hexane.

Another class of zeolites useful for hydrodewaxing are termed large pore zeolites which have a pore size larger than the medium pore zeolites. The pores of the large pore zeolites are sufficiently large to admit the vast majority of components normally found in a feedstock. These zeolites generally are stated to have a pore size in excess of 7.5 Angstroms and/or formed by 12-membered rings. The large pore zeolites are represented by ZSM-4, ZSM-12, ZSM-20, Zeolite Beta, Mordenite, TEA (tetra ethyl ammonium) Mordenite, Dealuminized Y, and Rare Earth Y. Additionally, the large pore component may include a low sodium Ultrastable Y molecular sieve (USY). Generally, with the exception of Zeolite Beta, the large pore zeolites have less hydrodewaxing effectiveness than the intermediate pore zeolites.

ZSM-4 is more particularly described in U.S. Pat. No. 3,823,639.

ZSM-5 is more particularly described in U.S. Pat. No. 3,702,886 and Re. 29,948.

ZSM-11 is more particularly described in U.S. Pat. No. 3,709,976.

ZSM-12 is more particularly described in U.S. Pat. No. 3,832,449.

ZSM-20 is more particularly described in U.S. Pat. No. 3,972,983.

ZSM-23 is more particularly described in U.S. Pat. No. 4,076,842.

ZSM-35 is more particularly described in U.S. Pat. No. 4,016,245.

ZSM-38 is more particularly described in U.S. Pat. No. 4,046,859.

ZSM-48 is more particularly described in U.S. Pat. No. 4,397,827.

Zeolite Beta is more particularly described in U.S. Pat. Nos. 3,308,069 and Re. 28,341.

USY is more particularly described in U.S. Pat. Nos. 3,293,192 and 3,449,070.

A suitable shape selective catalyst for a fixed bed reactor or for a reactor having a screw for moving the catalyst as does the instant invention is a ZSM-5 zeolite with alumina binder in the form of cylindrical extrudates of about 1–5 millimeters. Other catalysts which may be more particularly used in one or more reactors described herein include siliceous materials with pore size in the range of 5 to 9 Angstroms. These include borosilicates, ferrosilicates and/or aluminosilicates, disclosed in U.S. Pat. Nos. 4,414,143 and 4,417,088.

The zeolite will have a silica/alumina ratio of at least 12 for oligomerization and dewaxing. The desired low acid activity of the catalyst may be achieved by an unusually high silica/alumina ratio, greater than 1000, preferably upwards of about 1500.

Constraint Index

The members of the class of zeolites useful herein more specifically have an effective pore size of from about 5 to about 8 Angstroms to freely sorb normal hexane. In addition, the structures provide constrained access to larger molecules. It is sometimes possible to judge from a known crystal structure whether such constrained access exists. For example, if the only pore windows in the crystal are formed by 8-membered rings of silicon and aluminum atoms, then access by molecules of larger cross-section than normal hexane is excluded and the zeolite is not of the constrained type. Windows of 10-membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons, and therefore, it is not the present intention to entirely judge the usefulness of the particular zeolite solely from theoretical structural considerations.

A convenient measure of the extent to which a zeolite provides control to molecules of varying sizes to its internal structure is the Constraint Index of the zeolite. Zeolites which provide a highly restricted access to and egress from their internal structure have a high value for the Constraint Index, and zeolites of this kind usually have pores of small size, e.g., less than 5 Angstroms. On the other hand, zeolites which provide relatively free access to the internal zeolite structure have a low value for the Constraint Index, and usually pores of large size, e.g., greater than 8 Angstroms. The method by which Constraint Index is determined is described fully in U.S. Pat. No. 4,016,218, incorporated herein by reference for details of the method.

Constraint Index (CI) values for some typical materials are:

| | CI (at test temperature) | |
|---|---|---|
| ZSM-4 | 0.5 | (316° C.) |
| ZSM-5 | 6–8.3 | (371° C.–316° C.) |
| ZMS-11 | 5–8.7 | (371° C.–316° C.) |
| ZSM-12 | 2.3 | (316° C.) |
| ZSM-20 | 0.5 | (371° C.) |
| ZSM-22 | 7.3 | (427° C.) |
| ZSM-23 | 9.1 | (427° C.) |
| ZSM-34 | 50 | (371° C.) |
| ZSM-35 | 4.5 | (454° C.) |
| ZSM-38 | 2 | (510° C.) |
| ZSM-48 | 3.5 | (538° C.) |
| ZSM-50 | 2.1 | (427° C.) |
| TMA Offretite | 3.7 | (316° C.) |
| TEA Mordenite | 0.4 | (316° C.) |
| Clinoptilolite | 3.4 | (510° C.) |
| Mordenite | 0.5 | (316° C.) |
| REY | 0.4 | (316° C.) |
| Amorphous Silica-alumina | 0.6 | (538° C.) |
| Dealuminized Y | 0.5 | (510° C.) |
| Erionite | 38 | (316° C.) |
| Zeolite Beta | 0.6–2.0 | (316°–399° C.) |

The above-described Constraint Index is an important and even critical definition of those zeolites which are useful in the instant invention. The very nature of this parameter and the recited technique by which it is determined, however, admit of the possibility that a given zeolite can be tested under some what different conditions and thereby exhibit different Constraint Indexes. Constraint Index seems to vary somewhat with severity of operations (conversion) and the presence or absence of binders. Likewise, other variables, such as crystal size of the zeolite, the presence of occluded contaminants, etc., may affect the Constraint Index. Therefore, it will be appreciated that it may be possible to so select test conditions, e.g., temperature, such as to establish more than one value for the Constraint Index of a particular zeolite. This explains the range of Constraint Indexes for some zeolites, such as ZSM-5, ZSM-11 and Beta.

It is to be realized that the above CI values typically characterize the specified zeolites, but that such are the cumulative result of several variables useful in the determination and calculation thereof. Thus, for a given zeolite exhibiting a CI value within the range of 1 to 12, depending on the temperature employed during the test method within the range of 290° C. to about 538° C., with accompanying conversion between 10% and 60%, the CI may vary within the indicated range of 1 to 12. Likewise, other variables such as the crystal size of the zeolite, the presence of possibly occluded contaminants and binders intimately combined with the zeolite may affect the CI. It will accordingly be understood by those skilled in the art that the CI, as utilized herein, while affording a highly useful means for characterizing the zeolites of interest, is approximate, taking into consideration the manner of its determination, with the possibility, in some instances, of compounding variable extremes. However, in all instances, at a temperature within the above-specified range of 290° C. to about 538° C., the CI will have a value for any given zeolite of interest herein within the approximate range of 1 to 12.

SUMMARY

Examples

Aging data for a dewaxing catalyst was collected during a dewaxing process. The properties of the feed are listed in Table 1 and the properties of the catalyst are listed in Table 2.

TABLE 1

| Heavy Neutral | |
|---|---|
| API | 32° |
| Specific Gravity | 0.865 |
| Viscosity | |
| KV at 100° C. | 11.42 |
| KV at 300° F. | 4.636 |
| Aniline Point | 251 |
| Elemental Analysis, Wt. % | |
| Carbon | balance |
| Hydrogen | 14.01 |
| Sulfur | 0.19 |
| Nitrogen (ppm) | 100.00 |
| Paraffins, wt % | 38.9 |
| Mono Naphthenes | 13.4 |
| Poly Naphthenes | 27.9 |
| Aromatics | 19.7 |
| MW | 545 |
| Flash Point, °F. | 516 |
| Pour Point, °F. | 120 |
| Distillation Vol % | °F. |
| IBP | 764 |
| 5 | 861 |
| 10 | 917 |
| 20 | 945 |
| 30 | 961 |
| 40 | 973 |
| 50 | 983 |
| 60 | 992 |
| 70 | 1004 |
| 80 | 1017 |
| 90 | 1035 |
| 95 | 1050 |
| End Point | 1061 |

TABLE 2

| | |
|---|---|
| Catalyst Particle Diameter, inch | 1/16 |
| Surface Area, $m^2/gm$ | 349 |
| Real Density, gm/cc | 2.67 |
| Particle Density, gm/cc | 0.91 |
| Pore Volume, cc/gm | 0.724 |
| Avg. Pore Diameter, Angstroms | 83 |
| Alpha Value | 98 |
| Nickel, wt % | 0.92 |
| Sodium ppm | 290 |

FIG. 1 summarizes aging data for catalyst used in a two-stage catalytic dewaxing of the heavy neutral raffinate having the properties as shown in Table 1 over a 50/50 split of 1/16th inch steamed nickel ZSM-5 catalyst having the properties shown in Table 2. FIG. 1 clearly demonstrates line-out aging of stage-one dewaxing catalyst in dewaxing a feedstock to an intermediate pour point of 65° F., and the concave upward, cycle-limiting aging of the stage-two dewaxing catalyst in producing a product having a targeted pour point.

Figure 2:
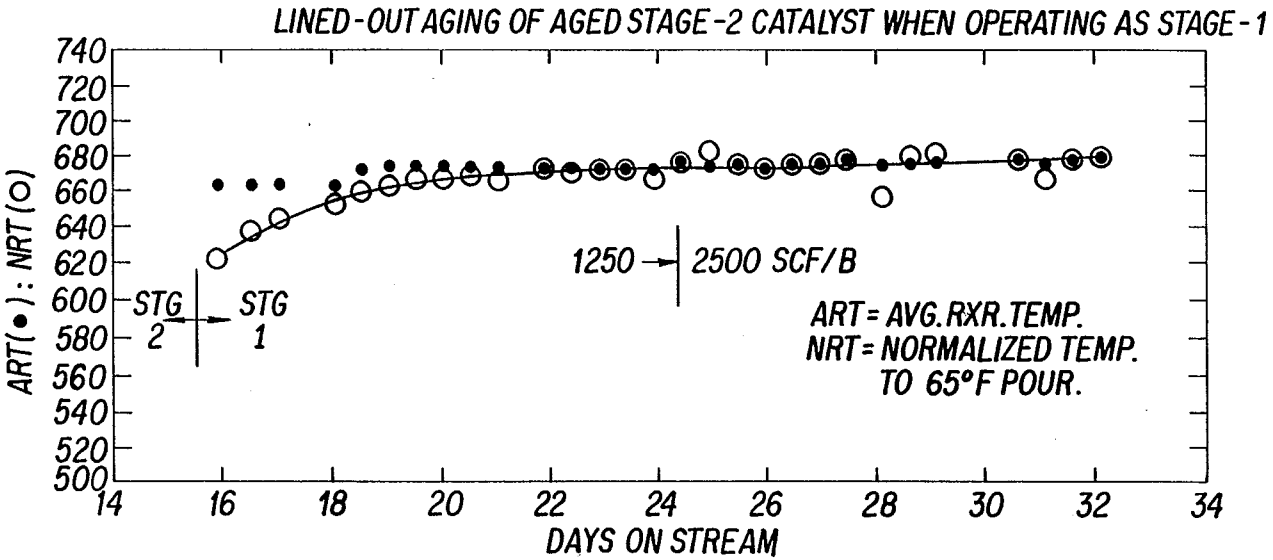
FIG. 2 plots reactor temperature versus days on-stream to depict the line-out aging of aged stage-two dewaxing catalyst used as a stage-one dewaxing catalyst.
Figure 3:
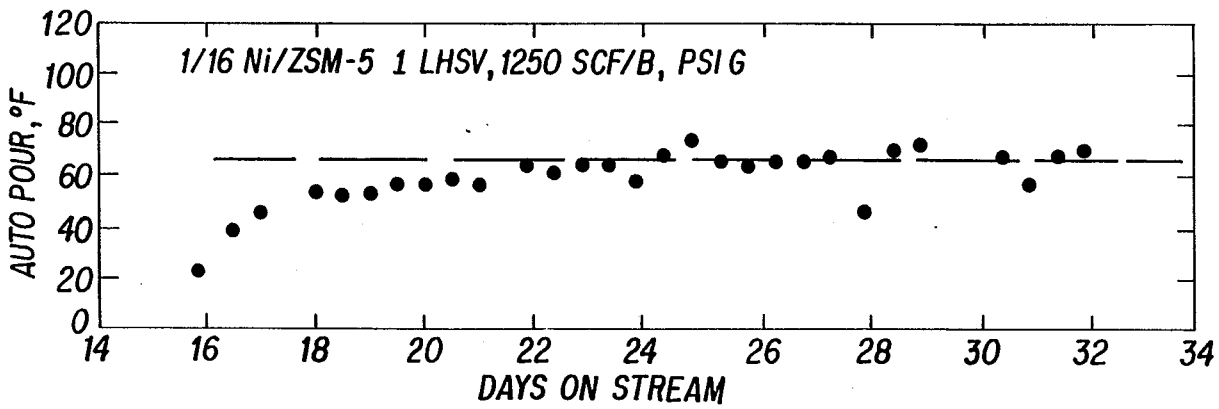
FIG. 3 plots pour point vs. days on-stream to depict the line-out aging of aged stage-two dewaxing catalyst used as a stage-one dewaxing catalyst.

FIGS. 2 and 3 depict the line-out aging of aged stage-two dewaxing catalyst when it was switched to dewaxing an original feed charge as a stage-one dewaxing catalyst. The pour points in FIGS. 2 and 3 are for the 650° F. portion of the respective dewaxed effluents. Auto Pour, shown on FIG. 3 is a standard method of pour point measurement.

The process of the instant invention allows for the continuous dewaxing of lube feedstocks. The continuous process results in the ability to process more feed especially in view of the fact that reactor down-time, due to catalyst reactivation, is avoided. In summary, the benefits of the instant process are: (1) maximization of the stream factor, (2) freedom to select desirable operating temperatures to achieve a better quality product, (3) more uniform catalytic activity and, (4) the continuous dewaxing process allows an operator to select the rate or amount of catalyst feed to the reactor so that feeds of varying difficulties can be dewaxed.

While specific embodiments of the process and apparatus aspects of the invention have been shown and described, it should be apparent that many modifications can be made thereto without departing from the spirit and scope of the invention. Accordingly, the invention is not limited by the foregoing description, but is only limited by the scope of the claims.

We claim:

1. A continuous process for catalytically dewaxing a hydrocarbon feedstock wherein a countercurrent flow of catalyst and oil is obtained comprising:

(a) assembling a plurality of dewaxing reactors in series, operating under dewaxing conditions;

(b) charging a first reactor, being last in the series, with hydrogen gas, hydrocarbon feedstock and first charge of a dewaxing catalyst;

(c) withdrawing a partially dewaxed hydrocarbon feedstock and unreacted hydrogen gas from the first reactor;

(d) charging a second reactor, being second in series, with the partially dewaxed hydrocarbon feedstock and unreacted hydrogen gas and a second charge of dewaxing catalyst to produce a product having a reduced pour point relative to the hydrocarbon feedstock; and (e) withdrawing the product having a reduced pour point, wherein said first charge of catalyst is supplied from the second reactor so that catalyst which dewaxes the harder to dewax components and which has undergone concave upward aging is moved to a position to conduct easier dewaxing and to undergo line-out aging, and the second charge of dewaxing catalyst is fresh catalyst.

2. The process according to claim 1, further comprising removing deactivated catalyst from the first reactor.

3. The process according to claim 2, further comprising reactivating the deactivated catalyst.

4. The process according to claim 3, wherein catalyst reactivation is conducted in a reducing atmosphere.

5. The process according to claim 4, wherein catalyst reactivation is conducted in an oxidizing atmosphere.

6. The process according to claim 5, wherein the reactivated catalyst is returned to the second reactor in the series.

7. The process according to claim 6, wherein the dewaxing catalyst is a medium pore size crystalline zeolite catalyst.

8. The process according to claim 7, wherein the dewaxing catalyst has a Constraint Index of between 1 and 12.

9. The process according to claim 8, wherein the dewaxing catalyst is selected from the group consisting of ZSM-5, ZSM-11, ZSM-12, ZSM-23, ZSM-35, ZSM-38 and ZSM-48.

10. A continuous process for catalytically dewaxing a hydrocarbon feedstock wherein a countercurrent flow of catalyst and oil is obtained comprising:

(a) assembling a plurality of dewaxing reactors in series, operating under dewaxing conditions;

(b) charging a first reactor, being last in the series, with hydrogen gas, hydrocarbon feedstock and first charge of a dewaxing catalyst;

(c) withdrawing a partially dewaxed hydrocarbon feedstock and unreacted hydrogen gas from the first reactor;

(d) charging a second reactor, being second in series, with the partially dewaxed hydrocarbon feedstock and unreacted hydrogen gas and a second charge of dewaxing catalyst to produce an intermediate pour point feedstock;

(e) withdrawing the intermediate pour point feedstock and additional unreacted hydrogen gas from the second reactor;

(f) charging a third reactor, being first in the series, with the intermediate pour point feedstock and unreacted hydrogen and a third charge of dewaxing catalyst to produce a dewaxed product having a targeted pour point; and (g) withdrawing the product wherein said first charge of catalyst is supplied from the second reactor, the second charge of catalyst is supplied from the third reactor, and the third charge of catalyst is fresh catalyst.

* * * * *